US009580775B2

(12) United States Patent
Lin

(10) Patent No.: US 9,580,775 B2
(45) **Date of Patent: *Feb. 28, 2017**

(54) HEAT TREATABLE ALUMINUM ALLOYS HAVING MAGNESIUM AND ZINC AND METHODS FOR PRODUCING THE SAME

(71) Applicant: ALCOA INC., Pittsburgh, PA (US)

(72) Inventor: Jen Lin, Export, PA (US)

(73) Assignee: ARCONIC INC., Pittsburgh, PA (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/087,636

(22) Filed: Mar. 31, 2016

(65) Prior Publication Data

US 2016/0215371 A1 Jul. 28, 2016

Related U.S. Application Data

(63) Continuation of application No. 13/791,989, filed on Mar. 9, 2013, now Pat. No. 9,315,885.

(51) Int. Cl.

| | |
|---|---|
| ***C22C 21/06*** | (2006.01) |
| ***C22C 21/08*** | (2006.01) |
| ***C22C 21/10*** | (2006.01) |
| ***C22F 1/047*** | (2006.01) |
| ***C22F 1/053*** | (2006.01) |
| ***B22D 21/00*** | (2006.01) |

(52) U.S. Cl.

CPC ..... *C22C 21/08* (2013.01); *B22D 21/007* (2013.01); *C22C 21/06* (2013.01); *C22F 1/047* (2013.01)

(58) Field of Classification Search

CPC ..... C22C 21/06; C22C 21/08; C22C 21/10; C22F 1/047; C22F 1/053

USPC ..... 148/549; 420/541, 532

See application file for complete search history.

(56) References Cited

U.S. PATENT DOCUMENTS

| | | | | | |
|---|---|---|---|---|---|
| 3,843,357 | A * | 10/1974 | Niimi | C22C 21/10 | 420/532 |
| 4,840,685 | A * | 6/1989 | Nabae | C22C 21/06 | 420/532 |
| 5,759,302 | A * | 6/1998 | Nakai | C22C 21/12 | 420/541 |
| 8,157,932 | B2 * | 4/2012 | Yan | C22C 21/10 | 420/532 |
| 9,315,885 | B2 * | 4/2016 | Lin | C22F 1/047 | |
| 2005/0238528 | A1 * | 10/2005 | Lin | C22C 21/10 | 420/532 |
| 2006/0016523 | A1 * | 1/2006 | Dif | C22F 1/053 | 420/541 |

(Continued)

FOREIGN PATENT DOCUMENTS

| | | | |
|---|---|---|---|
| CN | 101590591 | | 12/2009 |
| EP | 2263811 | * | 3/2009 |

(Continued)

OTHER PUBLICATIONS

English translation of JP 2006/152403; Jun. 2006; 17 pages.*

(Continued)

*Primary Examiner* — Helene Klemanski

(74) *Attorney, Agent, or Firm* — Greenberg Traurig, LLP

(57) ABSTRACT

New heat treatable aluminum alloys having magnesium and zinc are disclosed. The new aluminum alloys generally contain 3.0-6.0 wt. % Mg, 2.5-5.0 wt. % Zn, where (wt. % Mg)/(wt. % Zn) is from 0.60 to 2.40.

20 Claims, 4 Drawing Sheets

(56) References Cited

U.S. PATENT DOCUMENTS

| | | | | |
|---|---|---|---|---|
| 2006/0032560 | A1* | 2/2006 | Benedictus | C22F 1/04 148/552 |
| 2007/0017604 | A1* | 1/2007 | Yan | C22F 1/053 148/549 |
| 2010/0037998 | A1* | 2/2010 | Bray | C22C 21/10 420/532 |
| 2010/0319817 | A1* | 12/2010 | Norman | C22C 21/06 148/552 |
| 2014/0230974 | A1* | 8/2014 | Lin | C22F 1/047 148/695 |
| 2015/0020930 | A1* | 1/2015 | Kamat | C22C 21/10 148/551 |

FOREIGN PATENT DOCUMENTS

| | | | |
|---|---|---|---|
| JP | 08/325664 | * | 12/1996 |
| JP | 2006/152403 | * | 6/2006 |
| WO | WO 2013/133960 A1 | * | 9/2013 |

OTHER PUBLICATIONS

English translation of JP 08/325664; Dec. 1996; 13 pages.*
Office Action dated Aug. 3, 2016, from related Chinese Patent Application No. 201480013201.3.

* cited by examiner

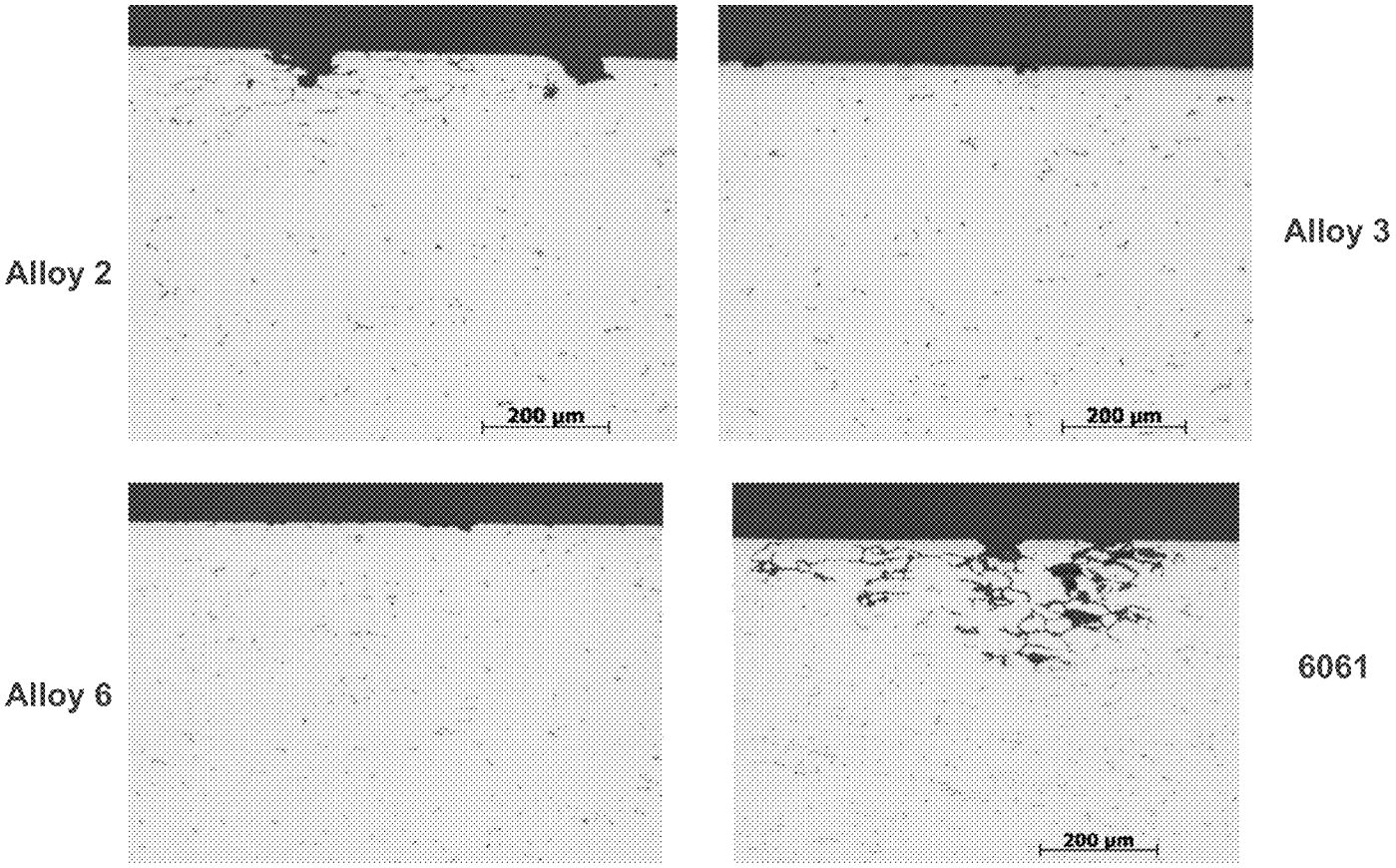
FIG. 4 - ASTM G110 24 hrs test on T/10

HEAT TREATABLE ALUMINUM ALLOYS HAVING MAGNESIUM AND ZINC AND METHODS FOR PRODUCING THE SAME

CROSS-REFERENCE TO RELATED APPLICATION

This patent application is a continuation of U.S. patent application Ser. No. 13/791,989, filed Mar. 9, 2013, now U.S. Pat. No. 9,315,885, entitled "HEAT TREATABLE ALUMINUM ALLOYS HAVING MAGNESIUM AND ZINC AND METHODS FOR PRODUCING THE SAME", which is incorporated herein by reference in its entirety.

BACKGROUND

Aluminum alloys are useful in a variety of applications. However, improving one property of an aluminum alloy without degrading another property is elusive. For example, it is difficult to increase the strength of an alloy without decreasing the toughness of an alloy. Other properties of interest for aluminum alloys include corrosion resistance and fatigue crack growth resistance, to name two.

SUMMARY OF THE DISCLOSURE

Broadly, the present patent application relates to improved heat treatable aluminum alloys having magnesium and zinc ("magnesium-zinc aluminum alloys"), and methods of producing the same. For purposes of the present application, magnesium-zinc aluminum alloys are aluminum alloys having 3.0-6.0 wt. % magnesium and 2.5-5.0 wt. % zinc, where at least one of the magnesium and the zinc is the predominate alloying element of the aluminum alloy other than aluminum, and wherein (wt. % Mg)/(wt. % Zn) is from 0.6 to 2.40. The new magnesium-zinc aluminum alloys may include copper, silicon, iron, secondary elements and/or other elements, as defined below.

The new magnesium-zinc aluminum alloys generally include 3.0-6.0 wt. % magnesium (Mg) In one embodiment, a magnesium-zinc aluminum alloy includes at least 3.25 wt. % Mg. In another embodiment, a magnesium-zinc aluminum alloy includes at least 3.50 wt. % Mg. In yet another embodiment, a magnesium-zinc aluminum alloy includes at least 3.75 wt. % Mg. In one embodiment, a magnesium-zinc aluminum alloy includes not greater than 5.5 wt. % Mg. In another embodiment, a magnesium-zinc aluminum alloy includes not greater than 5.0 wt. % Mg. In yet another embodiment, a magnesium-zinc aluminum alloy includes not greater than 4.5 wt. % Mg.

In one embodiment, a magnesium-zinc aluminum alloy includes at least 2.75 wt. % Zn. In another embodiment, a magnesium-zinc aluminum alloy includes at least 3.0 wt. % Zn. In another embodiment, a magnesium-zinc aluminum alloy includes at least 3.25 wt. % Zn. In one embodiment, a magnesium-zinc aluminum alloy includes not greater than 4.5 wt. % Zn. In one embodiment, a magnesium-zinc aluminum alloy includes not greater than 4.0 wt. % Zn.

In one embodiment, the (wt. % Mg)/(wt. % Zn) (i.e. the Mg/Zn ratio) is at least 0.75. In another embodiment, the (wt. % Mg)/(wt. % Zn) is at least 0.90. In yet another embodiment, the (wt. % Mg)/(wt. % Zn) is at least 1.0. In another embodiment, the (wt. % Mg)/(wt. % Zn) is at least 1.02. In one embodiment, the (wt. % Mg)/(wt. % Zn) (i.e. the Mg/Zn ratio) is not greater than 2.00. In another embodiment, the (wt. % Mg)/(wt. % Zn) is not greater than 1.75. In another embodiment, the (wt. % Mg)/(wt. % Zn) is not greater than 1.50.

The new magnesium-zinc aluminum alloys may include copper and/or silicon. In one embodiment, a magnesium-zinc aluminum alloy includes copper. In another embodiment, a magnesium-zinc aluminum alloy includes silicon. In yet another embodiment, a magnesium-zinc aluminum alloy includes both copper and silicon.

When copper is used, the magnesium-zinc aluminum alloys generally include at least 0.05 wt. % Cu. In one embodiment, a magnesium-zinc aluminum alloy includes at least 0.10 wt. % Cu. The magnesium-zinc aluminum alloys generally include not greater than 1.0 wt. % Cu, such as not greater than 0.5 wt. % Cu. In other embodiments, copper is included in the alloy as an impurity, and in these embodiments is present at levels of less than 0.05 wt. % Cu.

When silicon is used, the magnesium-zinc aluminum alloys generally include at least 0.10 wt. % Si. In one embodiment, a magnesium-zinc aluminum alloy includes at least 0.15 wt. % Si. The magnesium-zinc aluminum alloys generally include not greater than 0.50 wt. % Si. In one embodiment, a magnesium-zinc aluminum alloy includes not greater than 0.35 wt. % Si. In another embodiment, a magnesium-zinc aluminum alloy includes not greater than 0.25 wt. % Si. In other embodiments, silicon is included in the alloy as an impurity, and in these embodiments is present at levels of less than 0.10 wt. % Si.

The new magnesium-zinc aluminum alloys may include at least one secondary element selected from the group consisting of Zr, Sc, Cr, Mn, Hf, V, Ti, and rare earth elements. Such elements may be used, for instance, to facilitate the appropriate grain structure in a resultant magnesium-zinc aluminum alloy product. The secondary elements may optionally be present as follows: up to 0.20 wt. % Zr, up to 0.30 wt. % Sc, up to 1.0 wt. % of Mn, up to 0.50 wt. % of Cr, up to 0.25 wt. % each of any of Hf, V, and rare earth elements, and up to 0.15 wt. % Ti. Zirconium (Zr) and/or scandium (Sc) are preferred for grain structure control. When zirconium is used, it is generally included in the new magnesium-zinc aluminum alloys at 0.05 to 0.20 wt. % Zr. In one embodiment, a new magnesium-zinc aluminum alloy includes 0.07 to 0.16 wt. % Zr. Scandium may be used in addition to, or as a substitute for zirconium, and, when present, is generally included in the new magnesium-zinc aluminum alloys at 0.05 to 0.30 wt. % Sc. In one embodiment, a new magnesium-zinc aluminum alloy includes 0.07 to 0.25 wt. % Sc. Chromium (Cr) may also be used in addition to, or as a substitute for zirconium, and/or scandium, and when present is generally included in the new magnesium-zinc aluminum alloys at 0.05 to 0.50 wt. % Cr. In one embodiment, a new magnesium-zinc aluminum alloy includes 0.05 to 0.35 wt. % Cr. In another embodiment, a new magnesium-zinc aluminum alloy includes 0.05 to 0.25 wt. % Cr. In other embodiments, any of zirconium, scandium, and/or chromium may be included in the alloy as an impurity, and in these embodiments such elements would be included in the alloy at less than 0.05 wt. %.

Hf, V and rare earth elements may be included an in an amount of up to 0.25 wt. % each (i.e., up to 0.25 wt. % each of any of Hf and V and up to 0.25 wt. % each of any rare earth element may be included). In one embodiment, a new magnesium-zinc aluminum alloy includes not greater than 0.05 wt. % each of Hf, V, and rare earth elements (not greater than 0.05 wt. % each of any of Hf and V and not greater than 0.05 wt. % each of any rare earth element may be included).

Titanium is preferred for grain refining, and, when present is generally included in the new magnesium-zinc aluminum alloys at 0.005 to 0.10 wt. % Ti. In one embodiment, a new magnesium-zinc aluminum alloy includes 0.01 to 0.05 wt. % Ti. In another embodiment, a new magnesium-zinc aluminum alloy includes 0.01 to 0.03 wt. % Ti.

Manganese (Mn) may be used in the new magnesium-zinc aluminum alloys and in an amount of up to 1.0 wt. %. In one embodiment, a new magnesium-zinc aluminum alloy includes not greater than 0.75 wt. % Mn. In another embodiment, a new magnesium-zinc aluminum alloy includes not greater than 0.60 wt. % Mn. In yet another embodiment, a new magnesium-zinc aluminum alloy includes not greater than 0.50 wt. % Mn. In another embodiment, a new magnesium-zinc aluminum alloy includes not greater than 0.40 wt. % Mn. In one embodiment, a new magnesium-zinc aluminum alloy includes at least 0.05 wt. % Mn. In another embodiment, a new magnesium-zinc aluminum alloy includes at least 0.10 wt. % Mn. In yet another embodiment, a new magnesium-zinc aluminum alloy includes at least 0.15 wt. % Mn. In another embodiment, a new magnesium-zinc aluminum alloy includes at least 0.20 wt. % Mn. In one embodiment, a new magnesium-zinc aluminum alloy is substantially free of manganese and includes less than 0.05 wt. % Mn.

Iron (Fe) may be present in the new magnesium-zinc aluminum alloys, and generally as an impurity. The iron content of the new magnesium-zinc aluminum alloys should generally not exceed about 0.35 wt. % Fe. In one embodiments, a new magnesium-zinc aluminum alloy includes not greater than about 0.25 wt. % Fe. In other embodiments, a new magnesium-zinc aluminum alloy may include not greater than about 0.15 wt. % Fe, or not greater than about 0.10 wt. % Fe, or not greater than about 0.08 wt. % Fe, or less.

Aside from the above-listed elements, the balance (remainder) of the new magnesium-zinc aluminum alloys is generally aluminum and other elements, where the new magnesium-zinc aluminum alloys include not greater than 0.15 wt. % each of these other elements, and with the total of these other elements does not exceed 0.35 wt. %. As used herein, "other elements" includes any elements of the periodic table other than the above-identified elements, i.e., any elements other than Al, Mg, Zn, Cu, Si, Fe, Zr, Sc, Cr, Mn, Ti, Hf, V, and rare earth elements. In one embodiment, a new magnesium-zinc aluminum alloy includes not greater than 0.10 wt. % each of other elements, and with the total of these other elements not exceeding 0.25 wt. %. In another embodiment, a new magnesium-zinc aluminum alloy includes not greater than 0.05 wt. % each of other elements, and with the total of these other elements not exceeding 0.15 wt. %. In yet another embodiment, a new magnesium-zinc aluminum alloy includes not greater than 0.03 wt. % each of other elements, and with the total of these other elements not exceeding 0.10 wt. %.

The total amount of elements contained in the aluminum (i.e., all of the above described elements, or the "alloying elements") should be chosen so that the aluminum alloy can be appropriately solution heat treated and quenched (e.g., to promote hardening while restricting the amount of constituent particles). In one embodiment, a magnesium-zinc aluminum alloy includes an amount of alloying elements that leaves the magnesium-zinc aluminum alloy free of, or substantially free of, soluble constituent particles after solution heat treating and quenching. In one embodiment, a magnesium-zinc aluminum alloy includes an amount of alloying elements that leaves the aluminum alloy with low amounts of (e.g., restricted/minimized) insoluble constituent particles after solution heat treating and quenching. In other embodiments, a magnesium-zinc aluminum alloy may benefit from controlled amounts of insoluble constituent particles.

Except where stated otherwise, the expression "up to" when referring to the amount of an element means that that elemental composition is optional and includes a zero amount of that particular compositional component. Unless stated otherwise, all compositional percentages are in weight percent (wt. %).

The new magnesium-zinc aluminum alloys may be processed into a variety of wrought forms, such as in rolled form (sheet, plate), as an extrusion, or as a forging, and in a variety of tempers. In this regard, the new magnesium-zinc aluminum alloys may be cast (e.g., direct chill cast or continuously cast), and then worked (hot and/or cold worked) into the appropriate product form (sheet, plate, extrusion, or forging). After working, the new magnesium-zinc aluminum alloys may be processed into one of a T temper and a W temper, as defined by the Aluminum Association. In one embodiment, a new magnesium-zinc aluminum alloy is processed to a "T temper" (thermally treated). In this regard, the new magnesium-zinc aluminum alloys may be processed to any of a T1, T2, T3, T4, T5, T6, T7, T8 or T9 temper, as defined by the Aluminum Association. In one embodiment, a new magnesium-zinc aluminum alloy is processed to one of a T4, T6 or T7 temper, where the new magnesium-zinc aluminum alloy is solution heat treated, and then quenched, and then either naturally aged (T4) or artificially aged (T6 or T7). In one embodiment, a new magnesium-zinc aluminum alloys is processed to one of a T3 or T8 temper, where the new magnesium-zinc aluminum alloy is solution heat treated, and then quenched, and then cold worked, and then either naturally aged (T3) or artificially aged (T8). In another embodiment, a new magnesium-zinc aluminum alloy is processed to an "W temper" (solution heat treated), as defined by the Aluminum Association. In yet another embodiment, no solution heat treatment is applied after working the aluminum alloy into the appropriate product form, and thus the new magnesium-zinc aluminum alloys may be processed to an "F temper" (as fabricated), as defined by the Aluminum Association.

The new magnesium-zinc aluminum alloys may be used in a variety of applications, such as in an automotive application or an aerospace application.

In one embodiment, the new magnesium-zinc aluminum alloys are used in an aerospace application, such as wing skins (upper and lower) or stringers/stiffeners, fuselage skin or stringers, ribs, frames, spars, seat tracks, bulkheads, circumferential frames, empennage (such as horizontal and vertical stabilizers), floor beams, seat tracks, doors, and control surface components (e.g., rudders, ailerons) among others.

In another embodiment, the new magnesium-zinc aluminum alloys are used in an automotive application, such as closure panels (e.g., hoods, fenders, doors, roofs, and trunk lids, among others), wheels, and critical strength applications, such as in body-in-white (e.g., pillars, reinforcements) applications, among others.

BRIEF DESCRIPTION OF THE DRAWINGS

FIG. 4 contains micrographs of alloys of Example 1 showing their corrosion resistance.

DETAILED DESCRIPTION

Example 1

Figure 1:
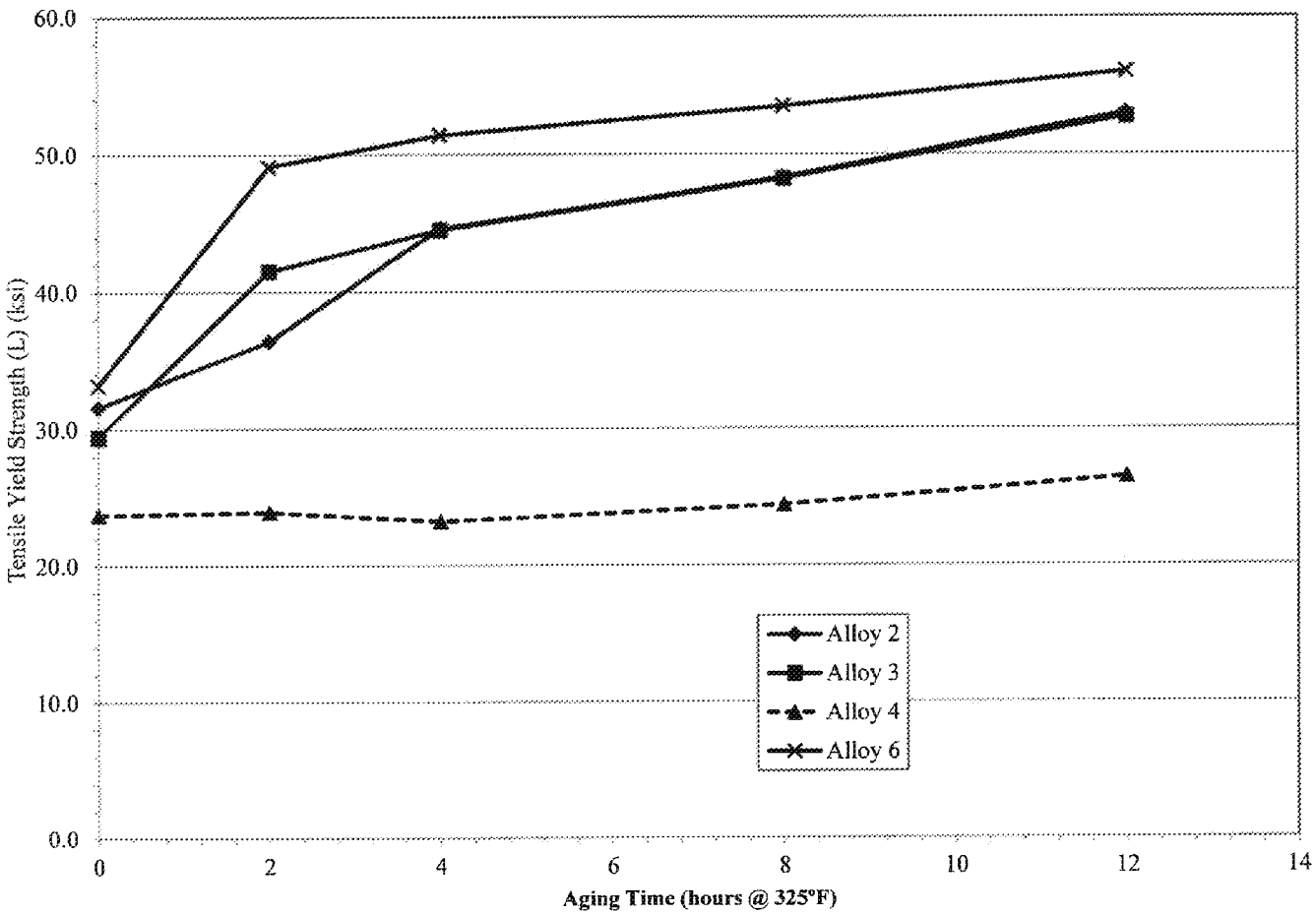
FIGS. 1-3 are graphs illustrating results of Example 1.

Six book mold ingots were cast (2.25" (H)×3.75" (W)×14" (L)) having the compositions shown in Table 1, below.

TABLE 1

Composition of Ex. 1 Alloys (in wt. %)

| Alloy | Mg | Zn | Mg/Zn | Cu | Mn | Note |
|---|---|---|---|---|---|---|
| 1 | 3.88 | 2.13 | 1.82 | 0.48 | 0.31 | Non-invention |
| 2 | 3.31 | 3.2 | 1.03 | 0.48 | 0.32 | Invention |
| 3 | 4.34 | 3.25 | 1.34 | 0 | 0.53 | Invention |
| 4 | 3.87 | 2.17 | 1.78 | 0.25 | 0.32 | Non-invention |
| 5 | 3.89 | 2.19 | 1.78 | 0.25 | 0.64 | Non-invention |
| 6 | 3.72 | 3.56 | 1.04 | 0 | 0.32 | Invention |

The alloys all contained not greater than about 0.12 wt. % Fe, not greater than about 0.11 wt. % Si, from about 0.01 to about 0.02 wt. % Ti, and from about 0.10 to 0.11 wt. % Zr. The remainder of the aluminum alloy was aluminum and other elements, where the aluminum alloy included not greater than 0.03 wt. % each of other elements, and with the total of these other elements not exceeding 0.10 wt. %.

The ingots were processed to a T6-style temper. Specifically, the ingots were homogenized, hot rolled to 0.5" gauge, solution heat treated and cold water quenched, and then stretched about 1-2% for flatness. The products were then naturally aged at least 96 hours at room temperature and then artificially aged at various temperatures for various times (shown below). After aging, mechanical properties were measured, the results of which are provided in Tables 2-4, below. Strength and elongation properties were measured in accordance with ASTM E8 and B557. Charpy impact energy tests were performed according to ASTM E23-07a.

TABLE 2

Properties (L) of Ex. 1 alloys - Aged at 325° F.

| Alloy | Aging Time (hours) | TYS (ksi) | UTS (ksi) | Elong. (%) |
|---|---|---|---|---|
| 2 | 0 | 31.6 | 50.2 | 32.0 |
| | 2 | 36.4 | 51.6 | 22.0 |
| | 4 | 44.6 | 58.7 | 21.0 |
| | 8 | 48.3 | 61.7 | 21.0 |
| | 12 | 53.0 | 65.5 | 18.0 |
| 3 | 0 | 29.4 | 52.8 | 32.0 |
| | 2 | 41.5 | 57.0 | 21.0 |
| | 4 | 44.5 | 58.1 | 19.0 |
| | 8 | 48.2 | 61.4 | 19.0 |
| | 12 | 52.7 | 65.8 | 15.0 |
| 4 | 0 | 23.7 | 47.4 | 36.0 |
| | 2 | 23.9 | 46.5 | 34.0 |
| | 4 | 23.2 | 44.8 | 33.0 |
| | 8 | 24.4 | 44.8 | 30.0 |
| | 12 | 26.4 | 46.7 | 29.0 |
| 6 | 0 | 33.2 | 51.9 | 29.0 |
| | 2 | 49.1 | 59.8 | 19.0 |
| | 4 | 51.4 | 61.5 | 18.0 |
| | 8 | 53.5 | 63.7 | 17.0 |
| | 12 | 56.0 | 66.9 | 16.0 |

TABLE 3

Properties (L) of Ex. 1 alloys - Aged at 350° F.

| Alloy | Aging Time (hours) | TYS (ksi) | UTS (ksi) | Elong. (%) | Charpy Impact Energy (ft-lbf) |
|---|---|---|---|---|---|
| 1 | 0 | 24.6 | 40.1 | 36.0 | — |
| | 2 | 25.6 | 47.1 | 30.0 | — |
| | 4 | 27.7 | 48.8 | 31.0 | — |
| | 8 | 28.6 | 48.5 | 28.0 | — |
| | 12 | 28.6 | 46.6 | 24.0 | — |
| 2 | 0 | 31.6 | 50.2 | 32.0 | — |
| | 2 | 45.8 | 59.3 | 19.0 | — |
| | 4 | 50.4 | 63.6 | 19.0 | 157 |
| | 8 | 46.4 | 60.4 | 18.0 | — |
| | 12 | 46.6 | 60.9 | 18.0 | — |
| 3 | 0 | 29.4 | 52.8 | 32.0 | — |
| | 2 | 41.4 | 56.4 | 18.0 | — |
| | 4 | 44.9 | 60.3 | 17.0 | 156 |
| | 8 | 43.6 | 58.8 | 17.0 | — |
| | 12 | 46.5 | 61.8 | 16.0 | — |
| 4 | 0 | 23.7 | 47.4 | 36.0 | — |
| | 2 | 24.2 | 45.5 | 28.0 | — |
| | 4 | 26.4 | 46.5 | 28.5 | — |
| | 8 | 30.0 | 50.5 | 21.0 | — |
| | 12 | 27.5 | 45.5 | 27.0 | — |
| 5 | 0 | 23.7 | 47.0 | 36.0 | — |
| | 2 | 24.7 | 47.2 | 26.0 | — |
| | 4 | 26.2 | 46.5 | 24.0 | — |
| | 8 | 28.6 | 48.8 | 24.0 | — |
| | 12 | 26.1 | 43.8 | 22.0 | — |
| 6 | 0 | 33.2 | 51.9 | 29.0 | — |
| | 2 | 51.7 | 62.5 | 18.0 | — |
| | 4 | 50.4 | 62.3 | 17.0 | 154 |
| | 8 | 51.6 | 64.2 | 16.0 | — |
| | 12 | 48.6 | 62.0 | 16.0 | — |

TABLE 4

Properties (L) of Ex. 1 alloys - Aged at 375° F.

| Alloy | Aging Time (hours) | TYS (ksi) | UTS (ksi) | Elong. (%) |
|---|---|---|---|---|
| 1 | 0 | 24.6 | 40.1 | 36.0 |
| | 1 | 26.0 | 47.4 | 35.0 |
| | 2 | 26.3 | 45.7 | 32.0 |
| | 4 | 28.1 | 47.0 | 27.0 |
| | 8 | 29.2 | 47.7 | 26.0 |
| 2 | 0 | 31.6 | 50.2 | 32.0 |
| | 1 | 42.0 | 57.0 | 20.0 |
| | 2 | 50.0 | 63.9 | 19.0 |
| | 4 | 40.6 | 56.2 | 18.0 |
| | 8 | 43.0 | 57.8 | 18.0 |
| 3 | 0 | 29.4 | 52.8 | 32.0 |
| | 1 | 43.9 | 58.7 | 17.0 |
| | 2 | 45.2 | 60.6 | 17.0 |
| | 4 | 41.4 | 57.5 | 18.0 |
| | 8 | 41.7 | 57.9 | 19.0 |
| 4 | 0 | 23.7 | 47.4 | 36.0 |
| | 1 | 27.6 | 46.9 | 26.0 |
| | 2 | 30.3 | 51.1 | 22.0 |
| | 4 | 28.8 | 48.0 | 22.0 |
| | 8 | 27.5 | 46.2 | 27.0 |
| 5 | 0 | 24.7 | 47.0 | 36.0 |
| | 1 | 25.9 | 48.2 | 30.0 |
| | 2 | 28.3 | 49.5 | 26.0 |
| | 4 | 27.4 | 46.4 | 20.0 |
| | 8 | 28.6 | 47.9 | 21.0 |
| 6 | 0 | 33.2 | 51.9 | 29.0 |
| | 1 | 46.0 | 58.0 | 18.0 |
| | 2 | 44.6 | 58.4 | 18.0 |
| | 4 | 46.4 | 60.6 | 17.0 |
| | 8 | 45.5 | 60.6 | 17.0 |

Figure 2:
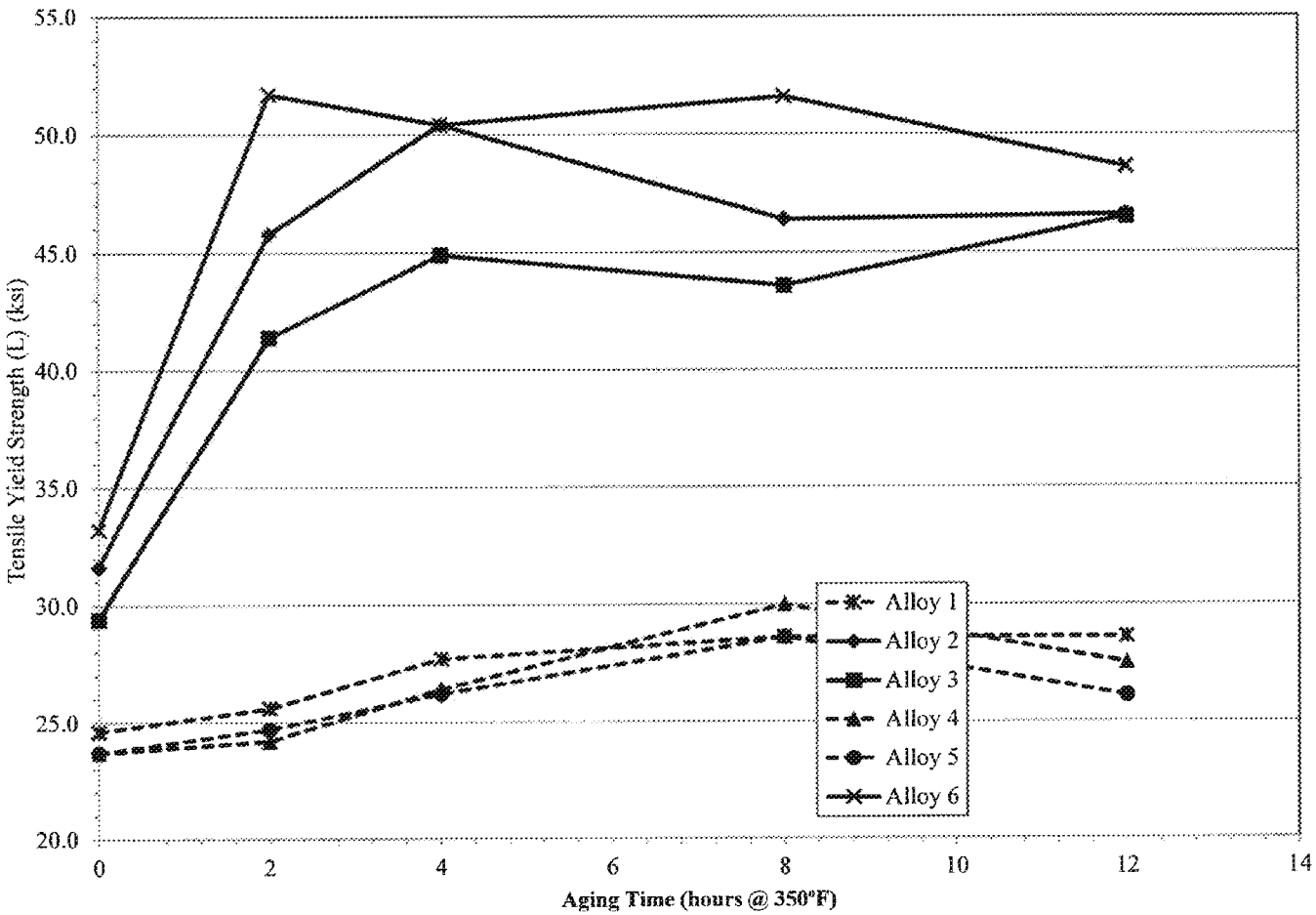
Figure 3:
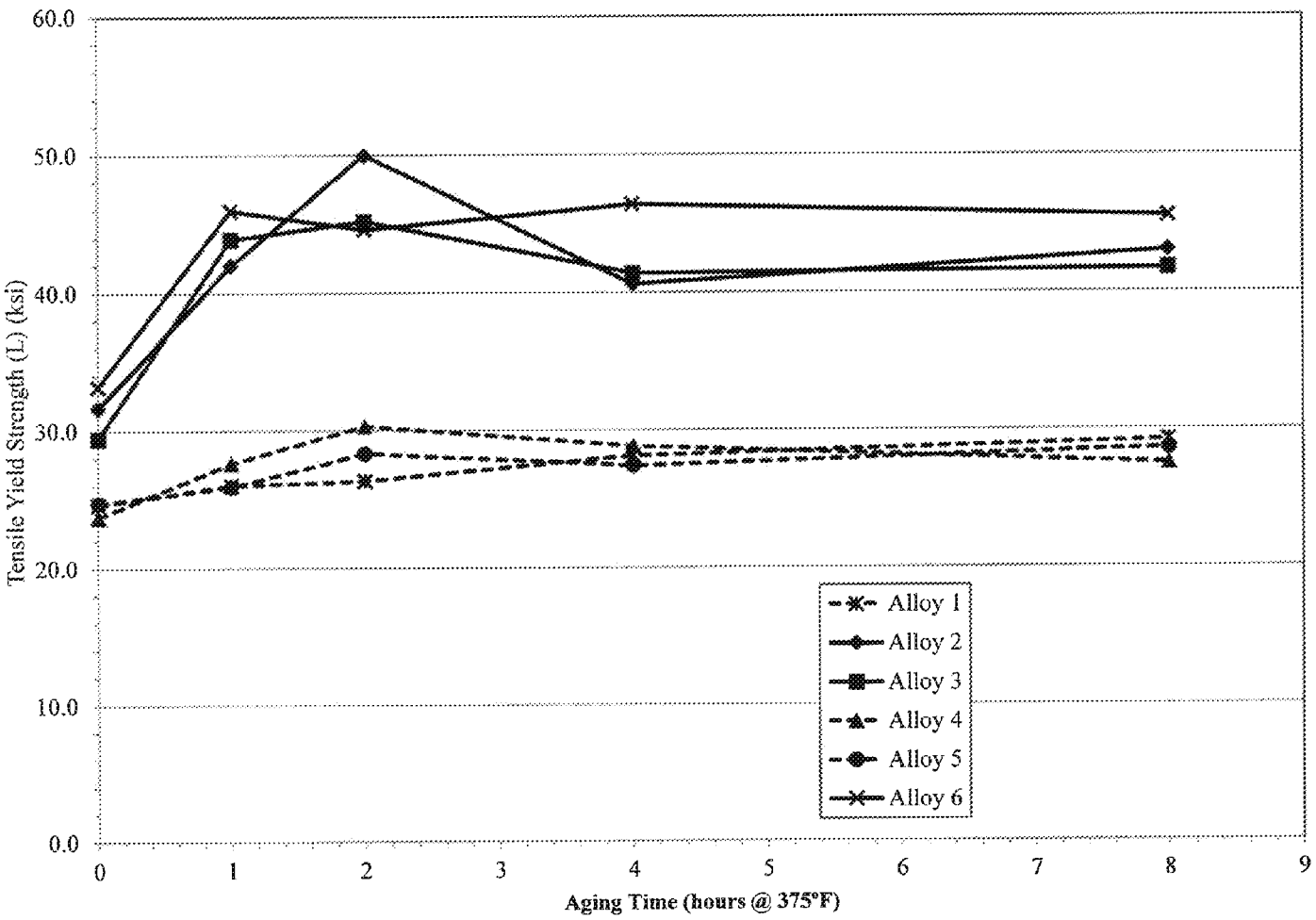

As shown above, and in FIGS. 1-3, the invention alloys having at least 3.0 wt. % Zn achieve higher strengths than the non-invention alloys having 2.19 wt. % Zn or less. The invention alloy also realize high charpy impact resistance, all realizing about 154-157 ft-lbf. By comparison, conventional alloy 6061 realized a charpy impact resistance of about 85 ft-lbf under similar processing conditions.

The invention alloys also realized good intergranular corrosion resistance. Alloys 3, 4 and 6 were tested for intergranular corrosion in accordance with ASTM G110. Conventional alloy 6061 was also tested for comparison purposes. As shown in FIG. 4 and in Table 5, below, the invention alloys realized improved intergranular corrosion resistance as compared to conventional alloy 6061.

TABLE 5

Corrosion Properties of Alloys - Peak Strength Condition (385° F. for 2 hours)

| | G110 - Depth of Attack - 24 hours (in.) | | | |
|---|---|---|---|---|
| Alloy | T/10 (ave.) | T10 (max.) | Surface (ave.) | Surface (max.) |
| 1 | 0.00886 | 0.00948 | 0.00499 | 0.00847 |
| 2 | 0.00811 | 0.01060 | 0.00685 | 0.00929 |
| 3 | 0.00062 | 0.00091 | 0.00200 | 0.00287 |
| 4 | 0.00063 | 0.00084 | 0.00291 | 0.00494 |
| 5 | 0.00064 | 0.00071 | 0.00522 | 0.00935 |
| 6 | 0.00078 | 0.00100 | 0.00729 | 0.02348 |
| 6061 | 0.01044 | 0.01385 | 0.00822 | 0.01141 |

Example 2

Alloy 6 of Example 1 was also processed with high cold work after solution heat treatment. Specifically, Alloy 6 was hot rolled to an intermediate gauge of 1.0 inch, solution heat treated, cold water quenched, and then cold rolled 50% (i.e., reduced in thickness by 50%) to a final gauge of 0.5 inch, thereby inducing 50% cold work. Alloy 6 was then artificially aged at 350° F. for 0.5 hour and 2 hours. Before and after aging, mechanical properties were measured, the results of which are provided in Table 6, below. Strength and elongation properties were measured in accordance with ASTM E8 and B557.

TABLE 6

Properties (L) of Ex. 2, Alloy 6 - Aged at 350° F.

| Aging Time (hours) | TYS (ksi) | UTS (ksi) | Elong. (%) |
|---|---|---|---|
| 0 | 58.5 | 68.6 | 13.0 |
| 0.5 | 58.9 | 67.2 | 16.0 |
| 2 | 56.0 | 64.7 | 16.0 |

As shown above, the 0.5 inch plate realizes high strength and with good elongation, achieving about a peak tensile yield strength of about 59 ksi, with an elongation of about 16% and with only 30 minutes of aging. By comparison, conventional alloy 5083 at similar thickness generally realizes a tensile yield strength (LT) of about 36 ksi at similar elongation and similar corrosion resistance.

While various embodiments of the present disclosure have been described in detail, it is apparent that modifications and adaptations of those embodiments will occur to those skilled in the art. However, it is to be expressly understood that such modifications and adaptations are within the spirit and scope of the present disclosure.

What is claimed is:

1. An aluminum alloy consisting of:

3.75-6.0 wt. % Mg;

2.5-5.0 wt. % Zn;

wherein (wt. % Mg)/(wt. % Zn) is from 0.6 to 2.40;

0.10-0.50 wt. % Mn;

up to 1.0 wt. % Cu;

up to 0.5 wt. % Si;

up to 0.20 wt, % Zr;

up to 0.30 wt. % Sc;

up to 0.50 wt. % Cr;

up to 0.25 wt. % each of any of Hf, V, and rare earth elements;

up to 0.15 wt. % Ti;

up to 0.35 wt. Fe; and the balance being aluminum and other elements, wherein the aluminum alloy includes not greater than 0.15 wt. % each of these other elements, and wherein the total of these other elements does not exceed 0.35 wt. %.

2. The aluminum alloy of claim 1, wherein the aluminum alloy includes not greater than 5.5 wt. % Mg.

3. The aluminum alloy of claim 1, wherein the aluminum alloy includes not greater than 5.0 wt. % Mg.

4. The aluminum alloy of claim 1, wherein the aluminum alloy includes not greater than 4.5 wt. % Mg.

5. The aluminum alloy of claim 1, wherein the aluminum alloy includes at least 2.75 wt. Zn.

6. The aluminum alloy of claim 1, wherein the aluminum alloy includes at least 3.0 wt. % Zn.

7. The aluminum alloy of claim 1, wherein the aluminum alloy includes at least 3.25 wt. % Zn.

8. The aluminum alloy of claim 1, wherein the aluminum alloy includes not greater than 4.5 wt. % Zn.

9. The aluminum alloy of claim 1, wherein the aluminum alloy includes not greater than 4.0 wt. % Zn.

10. The aluminum alloy of claim 1, wherein (wt. % Mg)/(wt. % Zn) is at least 0.75.

11. The aluminum alloy of claim 1, wherein (wt. % Mg)/(wt. % Zn) is at least 0.90.

12. The aluminum alloy of claim 1, wherein (wt. % Mg)/(wt. % Zn) is at least 1.00.

13. The aluminum alloy of claim 1, wherein (wt. % Mg)/(wt. % Zn) is at least 1.02.

14. The aluminum alloy of claim 1, wherein (wt. % Mg)/(wt. % Zn) is not greater than 2.00.

15. The aluminum alloy of claim 1, wherein (wt. % Mg)/(wt. % Zn) is not greater than 1.75.

16. The aluminum alloy of claim 1, wherein (wt. % Mg)/(wt. % Zn) is not greater than 1.50.

17. The aluminum alloy of claim 1, wherein the aluminum alloy includes 0.05-0.20 wt. Zr.

18. The aluminum alloy of claim 1, wherein the aluminum alloy includes at least 0.10 wt. % Cu and not greater than 0.5 wt. % Cu.

19. A method comprising:

(a) casting the aluminum alloy of claim 1 into an aluminum alloy body;

(b) processing the aluminum alloy body into one of a W temper and a T temper, wherein the processing step (b) comprises solution heat treating and then quenching the aluminum alloy body.

20. The method of claim 19, wherein the processing comprises artificial aging the aluminum alloy body to one of a T6, T7 or a T8 temper, wherein the aluminum alloy body in the T6 or T7 temper realizes a higher strength than the aluminum alloy body in a T4 temper, or wherein the aluminum alloy body in the T8 temper realizes a higher strength than the aluminum alloy body in a T3 temper.

* * * * *